US007429301B2

(12) United States Patent
Sugimura et al.

(10) Patent No.: US 7,429,301 B2
(45) Date of Patent: Sep. 30, 2008

(54) ULTRA CLEAN SPRING STEEL

(75) Inventors: Tomoko Sugimura, Kobe (JP); Koichi Sakamoto, Kobe (JP); Atsuhiko Yoshida, Kobe (JP); Sumie Suda, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 372 days.

(21) Appl. No.: 11/284,807

(22) Filed: Nov. 23, 2005

(65) Prior Publication Data

US 2006/0108027 A1 May 25, 2006

(30) Foreign Application Priority Data

Nov. 24, 2004 (JP) ..... 2004-339328

(51) Int. Cl.
*C22C 38/02* (2006.01)
*C22C 38/04* (2006.01)

(52) U.S. Cl. ..... 148/320; 148/333; 148/334; 148/335; 148/336; 148/908

(58) Field of Classification Search ..... 148/332–336, 148/320, 908, 595–598, 580; 428/606
See application file for complete search history.

(56) References Cited

U.S. PATENT DOCUMENTS 6,328,820 B1 12/2001 Yamamoto et al.

FOREIGN PATENT DOCUMENTS

| | | |
|---|---|---|
| EP | 1 010 769 A1 | 6/2000 |
| JP | 6-74484 | 9/1994 |
| JP | 6-74485 | 9/1994 |
| JP | 06-306542 | * 11/1994 |
| JP | 7-6037 | 1/1995 |
| JP | 2654099 | 5/1997 |
| JP | 2002-167647 | 6/2002 |
| KR | 2000-0047935 | 7/2000 |

OTHER PUBLICATIONS

Computer-generated English translation of Japanese patent 06158226 dated Jul. 6, 1994, Koyasu Yoshiro.*
"Recent Development of Production Technology for Super-clean Wire Rod, The 126th and 127th Nishiyama Memorial Technical Lecture", ed. by The Iron and Steel Institute of Japan, Tokyo, 1988, pp. 145-165 (with partial English translation).
Patent Abstracts of Japan, JP 06-145895, May 27, 1994.
Patent Abstracts of Japan, JP 06-158226, Jun. 7, 1994.
Patent Abstracts of Japan, JP 04-006211, Jan. 10, 1992.
Patent Abstracts of Japan, JP 02-034748, Feb. 5, 1990.

* cited by examiner

*Primary Examiner*—Deborah Yee
(74) *Attorney, Agent, or Firm*—Oblon, Spivak, McClelland, Maier & Neustadt, P.C.

(57) ABSTRACT

Disclosed herein is an ultra clean spring steel which contains inclusions easily elongated and broken into fine particles by hot rolling and which is easily adaptive to cold rolling and yields springs excelling in fatigue characteristics. The spring steel is characterized in that the wire contains oxide inclusions with a sulfur concentration no more than 10 mass % such that no less than 70% (in terms of numbers) of such inclusions, which exist in the outer layer outside one quarter of the diameter of the wire and have a width no smaller than 3 μm, satisfies the formula (1) below, $$CaO+Al_2O_3+SiO_2+MnO+MgO>80 \text{ (mass \%)}. \quad (1)$$

4 Claims, 9 Drawing Sheets

TEST No.1

TEST No.1

TEST No.2

TEST No.3

TEST No.4

TEST No.5

TEST No.6

TEST No.7

TEST No.8

TEST No.9

ULTRA CLEAN SPRING STEEL

BACKGROUND OF THE INVENTION

1. Field of the Invention

The present invention relates to a spring steel excellent in fatigue characteristics. This spring steel yields springs such as engine valve springs, clutch springs, and brake springs which need outstanding fatigue characteristics.

2. Description of the Related Art

There has been an increasing demand for automobiles with lighter weight and higher output, and this demand necessitates development of engine valve springs and suspension springs that endure high stress. These springs are required to have good fatigue resistance and sag resistance so that they can support a large load stress. Valve springs are particularly required to have good fatigue strength, and this requirement is hardly met even with SWOSC-V (JIS G-3566) which is said to be best in fatigue strength among conventional steels.

The steel wire for springs which needs high fatigue strength is required to contain a minimum amount of hard nonmetallic inclusions therein. This requirement is usually met with a specially clean steel from which nonmetallic inclusions are eliminated to the limit. The higher is the steel strength, the higher is the possibility of steel experiencing fracture and fatigue due to nonmetallic inclusions. Consequently, there are more stringent requirements for reduction (in amount and size) of nonmetallic inclusions leading to fracture.

There have been proposed a variety of techniques to reduce the amount and size of hard nonmetallic inclusions in steel. For example, Non-patent Document 1 given below mentions that it is possible to improve fatigue characteristics by making steel to contain $CaO—Al_2O_3—SiO_2$ inclusions having a melting point of about 1400 to 1500° C. and that such inclusions do not start fatigue fracture.

Moreover, Patent Documents 1 and 2 given below disclose an ultra clean steel excelling in fatigue characteristics which is produced in such a way that nonmetallic inclusions are sufficiently elongated at the time of hot rolling.

Also, Patent Documents 3 and 4 given below disclose a Si-deoxidized steel in which inclusions are elongated and made smaller in size by means of alkali metal compounds.

In addition, Patent Document 5 given below discloses a technique to reduce the amount of inclusions as well as the sectional area of inclusions at the time of hot rolling by lowering the melting point.

Non-patent Document 1

The 126th and 127th Nishiyama Memorial Technical Lecture, Japan Iron and Steel Association, pp. 145-165.

Patent Document 1

Japanese Patent Publication No. Hei-6-74484

Patent Document 2

Japanese Patent Publication No. Hei-6-74485

Patent Document 3

Japanese Patent Laid-open No. 2002-167647

Patent Document 4

Japanese Patent No. 2654099

Patent Document 5

Japanese Patent Publication No. Hei-7-6037

OBJECT AND SUMMARY OF THE INVENTION

Conventional technologies disclosed so far are concerned with the composition of nonmetallic inclusions that permits their easy elongation and size reduction at the time of hot rolling.

However, they merely pay attention to the average composition of inclusions but they do not consider anything about the configuration of inclusions that changes after hot rolling. Therefore, they cannot realize the ultra clean steel to meet recent requirements for the higher degree of cleanness.

The present invention was completed in view of the foregoing. Thus, it is an object of the present invention to provide an ultra clean spring steel excelling in fatigue characteristics. This object is achieved by sufficiently reducing the size of inclusions at the time of hot rolling.

The gist of the present invention resides in an ultra clean spring steel characterized in that the wire contains oxide inclusions with a sulfur concentration no more than 10 mass % such that no less than 70% (in terms of numbers) of such inclusions, which exist in the outer layer outside one quarter of the diameter of the wire and have a width no smaller than 3 μm, satisfies the formula (1) below, $$CaO+Al_2O_3+SiO_2+MnO+MgO>80 \text{ (mass \%)} \quad (1)$$

and also exists in two or three of the composition regions defined in (A) to (C) below.

(A) $SiO_2$: 40-70%, $Al_2O_3$: 0-20%, CaO: 20-60%

(B) $SiO_2$: 30-65%, $Al_2O_3$: 25-50%, CaO: 10-30%

(C) $SiO_2$: 10-30%, $Al_2O_3$: 25-50%, CaO: 30-55%

(% means mass %.)

provided that "width of inclusions" means the diameter of each inclusion which is measured in the direction perpendicular to its long axis, with inclusions being observed on the cross section containing the longitudinal axis of the wire, and the concentration (in terms of mass %) in (A) to (C) are normalized so that the total concentration of three components $SiO_2$, $Al_2O_3$, and CaO amounts to 100%.

The chemical composition of the ultra clean spring steel according to the present invention is not specifically restricted so long as it is designed for spring steel. A desirable composition is as follows.

C: no more than 1.2 mass % (excluding 0%)

Si: 0.4 to 4 mass %

Mn: 0.1-2.0 mass %

Al: no more than 0.01 mass % (excluding 0%)

The steel having the above-mentioned composition may contain one or more species of metals selected from the group consisting of Cr, Ni, V, Nb, Mo, W, Cu, and Ti. The content of these metals should preferably be as follows.

Cr: 0.5-3 mass %,

Ni: no more than 0.5 mass %, V: no more than 0.5 mass %,

Nb: no more than 0.1 mass %, Mo: no more than 0.5 mass %,

W: no more than 0.5 mass %, Cu: no more than 0.1 mass %, and Ti: no more than 0.1 mass %.

Any kind of steel should preferably contain Li in an amount of 0.01 to 20 ppm.

EFFECT OF THE INVENTION

The present invention provides an ultra clean spring steel which excels in fatigue characteristics because of its inclusions which are elongated and made smaller at the time of hot rolling.

DESCRIPTION OF THE PREFERRED EMBODIMENTS

Figure 1:
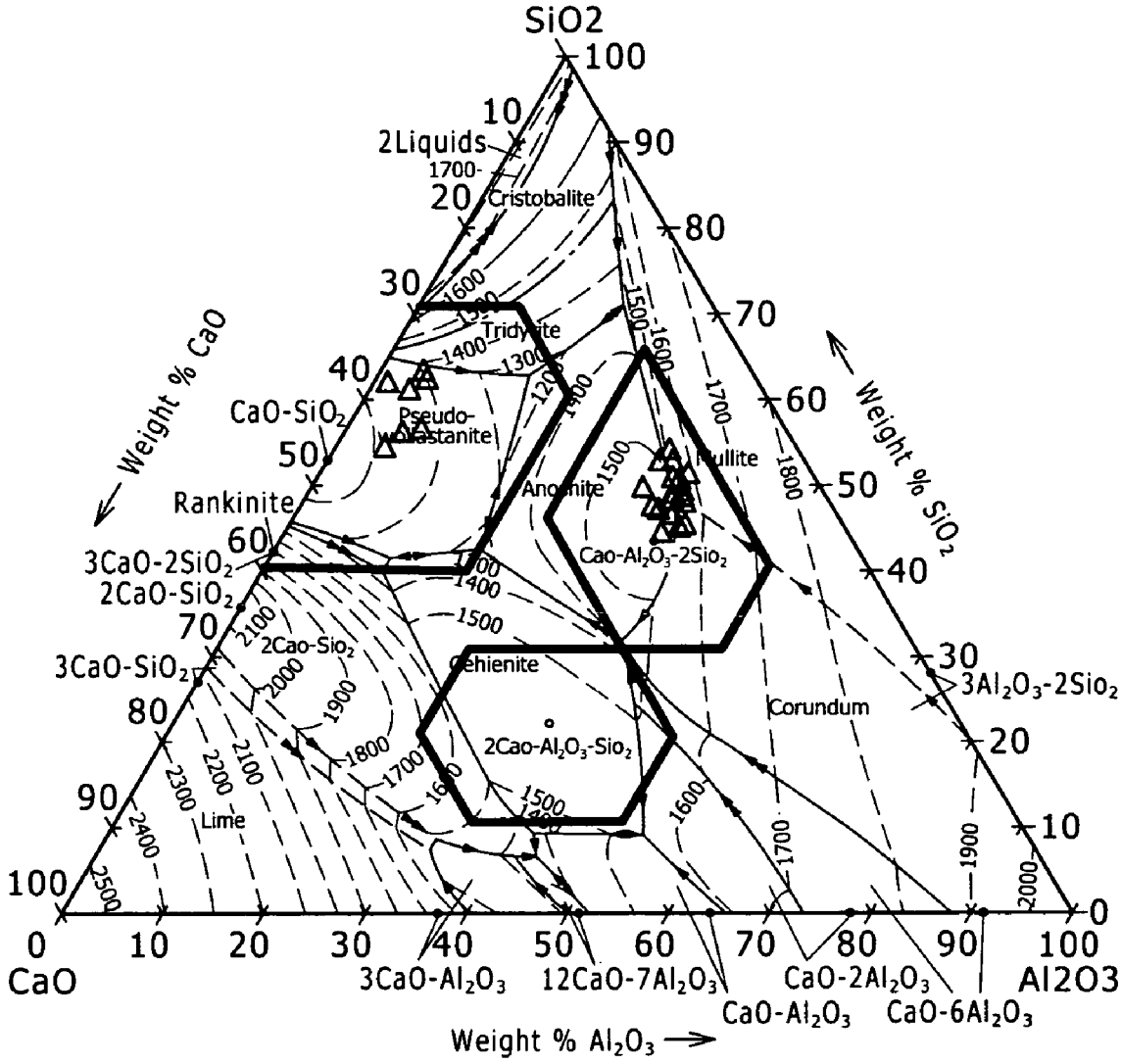
FIG. 1 is the composition distribution of inclusions in the specimen No. 1 in CaO—$Al_2O_3$—$SiO_2$ ternary phase diagram.

It is known that any wire that undergoes large deformation at the time of hot rolling should preferably contain inclusions that can be elongated and broken into fine particles during hot rolling. Therefore, it is common practice to make inclusions have an average composition with a low melting point so that inclusions are easily elongated and broken into fine particles at the time of hot rolling. Moreover, measures are being adopted to prevent the occurrence of harmful inclusions, such as $SiO_2$, $Al_2O_3$, anorthite, wollastonite, and gehlenite, throughout all the stages from solidification to hot rolling. These conventional technologies are still incomplete to meet the recent requirements.

With the foregoing in mind, the present inventors thought about how inclusions change in form during heating and hot rolling that follow solidification and studied from all viewpoints the composition and morphology of individual inclusions that affect improvement in fatigue characteristics. As the result it was found that a large number of fine crystals formed in inclusions cause inclusions to break into fine particles more readily than before at the time of hot rolling. It was also found that anorthite, wollastonite, and gehlenite, which are formed in this manner, are so fine that they do not adversely affect fatigue characteristics.

Phase separation is not the only object of the present invention. It is important that the phase resulting from phase separation should be almost harmless or fine. In other words, unless the composition of inclusions is not adequate before hot rolling, harmful $SiO_2$ and $Al_2O_3$ occur to adversely affect fatigue characteristics.

Therefore, it is necessary to strictly control the composition of inclusions before blooming and hot rolling. For this reason, it is necessary to perform refining by means of slag with higher basicity than before and to strictly control the concentration of aluminum.

The present invention should meet the following requirements. According to the present invention, the wire contains oxide inclusions with a sulfur concentration no more than 10 mass % such that no less than 70% (in terms of numbers) of such inclusions, which exist in the outer layer outside one quarter of the diameter of the wire and have a width no smaller than 3 μm, satisfies the formula (1) below, $$CaO+Al_2O_3+SiO_2+MnO+MgO>80 \text{ (mass \%)} \quad (1)$$

The foregoing specifies that the inclusions of interest should have "a width no smaller than 3 μm". The reason for this is that fine inclusions with a width smaller than 3 μm hardly cause fatigue fracture and have no remarkable effect on fatigue strength. The foregoing also specifies that such inclusions should "exist in the outer layer outside one quarter of the diameter of the wire". The reason for this is that inclusions existing in this region most affect fatigue characteristics.

Valve spring steel contains oxide inclusions and sulfide inclusions. The latter is so soft as to be readily elongated and broken into fine particles at the time of hot rolling, and hence it has little effect on fatigue strength. Therefore, it is necessary to control oxide inclusions in order to increase fatigue strength. This is the reason why the present invention is concerned with oxide inclusions but is not concerned with sulfide inclusions which contains more than 10 mass % sulfur.

The wire usually contains inevitable irregular inclusions (such as Ti oxides and Cr oxides) in addition to CaO, $Al_2O_3$, $SiO_2$, MnO, and MgO. They are not a matter of serious concern so long as their amount is limited. However, they will cause fatigue fracture as their amount increases. This is the reason why the present invention specifies that those irregular inclusions whose total amount [$CaO+Al_2O_3+SiO_2+MnO+MgO$] is less than 80 mass % should not exceed 30% in number.

The present invention specifies that the wire should contain oxide inclusions with a sulfur concentration no more than 10 mass % such that no less than 70% (in terms of numbers) of such inclusions exists in two or three of the composition regions defined in (A) to (C) below.

(A) $SiO_2$: 40-70%, $Al_2O_3$: 0-20%, CaO: 20-60%

(B) $SiO_2$: 30-65%, $Al_2O_3$: 25-50%, CaO: 10-30%

(C) $SiO_2$: 10-30%, $Al_2O_3$: 25-50%, CaO: 30-55%

The expression "no less than 70% (in terms of numbers) of such inclusions" is inserted because the present invention fully produces its effect if more than 70% of inclusion is controlled. Less than 70% means that there exist many inclusions of the form leading to fracture. Since MnO among inclusions is not specifically restricted in its concentration because it is harmless. Moreover, MgO is not intentionally added but originates from refractory, and hence its concentration is not a matter of concern.

In other words, the present invention permits oxide inclusions to exist in more than one composition region. A probable reason for this is that fine crystals occur in amorphous inclusions and they are broken into fine particles at the time of hot rolling. Crystallized inclusions are hardly broken at the time of hot rolling, and they remain in the final product to cause fatigue fracture. Generation of fine crystals implies suppressing the generation of large crystals. This is a probable reason for improvement in fatigue strength.

For the composition of inclusions to exist in more than one region, it is necessary to adequately control the chemical components of steel and the composition of inclusions (as mentioned later) and it is also necessary to adequately control the hot rolling conditions. It is particularly necessary to adequately control the heating temperature and time before blooming as follows.

Heating temperature: 1200-1350° C.

Heating time (or soaking time): longer than 4 hours

Blooming at an excessively low heating temperature hardly brings about crystallization, and blooming at an excessively high temperature gives rise to coarse crystals. Soaking time should preferably be longer than 4 hours so that the present invention fully produces its effect, although it was usually about 2 hours in the past. Blooming with an excessively long blooming time gives rise to coarse crystals; therefore, the soaking time should be shorter than 10 hours. Incidentally, the heating time may be reduced if inclusions contain $Li_2O$.

Fine crystals in inclusions help break inclusions into fine particles at the time of hot rolling. Consequently, it is important to control inclusions in stages before casting. Excessive $SiO_2$ present in inclusions forms coarse $SiO_2$ crystals during crystallization, and they remain as such at the time of hot rolling and adversely affect fatigue strength. Also, excessive $Al_2O_3$ in inclusions forms coarse $Al_2O_3$ crystals and anorthite ($CaOAl_2O_3.2SiO_2$), which adversely affect fatigue strength. Thus, it is important to control the composition so that various crystals precipitate evenly.

For this reason, it is necessary to adjust the basicity ($CaO/SiO_2$) of the slag composition in the stage of steel melting. Desirable basicity is in the range of about 0.75 to 2.

The present invention does not specifically restrict the chemical composition of steel because it is designed for an ultra clean steel useful as a raw material for spring steel. However, the steel according to the present invention should preferably contain Si and Mn as a deoxidizer in an amount no less than 0.1 mass %. However, Si should be less than 4% and Mn should be less than 2% because they make the steel brittle if they are present in an excess amount.

The content of carbon (as the basic component of spring steel) should preferably be less than 1.2 mass %. Excessive carbon (more than 1.2 mass %) makes the steel impracticably brittle.

Aluminum is an element useful to control inclusions. The concentration of aluminum should be 0.1-15 ppm (by mass). Excessive aluminum gives rise to coarse $Al_2O_3$ crystals which cause fatigue fracture. A concentration less than 0.01 mass % is desirable.

The steel according to the present invention is composed of Fe and inevitable impurities in addition to the above-mentioned basic components. It may optionally contain one or more species of metal selected from the group consisting of Cr, Ni, V, Nb, Mo, W, Cu, and Ti. Their desirable content is as follows.

Cr: 0.5-3 mass %, Ni: no more than 0.5 mass %,

V: no more than 0.5 mass %, Nb: no more than 0.1 mass %,

Mo: no more than 0.5 mass %, W: no more than 0.5 mass %,

Cu: no more than 0.1 mass %, and Ti: no more than 0.1 mass %.

The wire according to the present invention may optionally contain Li. Li effectively controls the composition of inclusions or causes fine particles to occur in inclusions. It also reduces the viscosity of the amorphous portion of inclusions, thereby allowing inclusions to deform easily. The content of Li for this purpose should preferably be about 0.01 to 20 ppm.

There are known technologies (as mentioned in Patent Documents 3 and 4 given above) which are designed to lower the melting point of inclusions by incorporation with Li, thereby allowing the steel to deform easily at the time of hot rolling. However, these technologies do not employ the effect of crystallization. Moreover, these technologies require that fine crystals should occur in large number and have the disadvantage that the addition of Li without an adequate control of inclusions promotes the formation of coarse crystals, thereby producing a reverse effect. Incidentally, Patent Document 3 given above does not mention specifically the addition of Li, nor does it mention anything about the effect of crystallization resulting from the addition of Li.

The invention will be described in more detail with reference the following examples which are not intended to restrict the scope thereof. The invention will be changed and modified without departing from the scope thereof.

EXAMPLE 1

A molten steel simulating a converter steel was prepared. It was incorporated with a variety of fluxes for chemical composition adjustment of steel and slag refining. The basicity of slag was adequately adjusted (as shown in Table 2) so as to control the composition of inclusions as desired. Thus there were obtained several steel samples having the chemical composition as shown in Table 1. Incidentally, the addition of Li to the molten steel may be accomplished by any one of the following methods, although the Li concentration was adjusted by wire feed of $Li_2CO_3$ in the case of steel samples Nos. 4 to 6. The wire for wire feed may be formed from Li alloy or $Li_2CO_3$ alone or in combination with other alloying materials.

(a) addition in the form of Li—Al or Li—Si by wire feed; in combination with other alloys; adding of mass into the molten steel, previous adding into the ladle; addition during the TD process.

(b) addition in the form of Li by wire feed; in combination with other alloys; adding of mass into the molten steel; previous adding into the ladle; addition during the TD process.

(c) addition of $Li_2O$ or $Li_2CO_3$ to slag.

(d) addition of $Li_2CO_3$ in combination with other alloys; adding of mass into the molten steel; previous adding into the ladle; addition during the TD process.

TABLE 1

| Steel | Chemical composition (mass %) | | | | | | |
|---|---|---|---|---|---|---|---|
| designation | C | Si | Mn | Al (ppm) | Ni | Cr | Li (ppm) |
| A | 0.6 | 2.0 | 0.7 | 6 | 0.2 | 1.0 | — |
| B | 0.55 | 1.45 | 0.7 | 10 | — | 0.7 | — |
| C | 0.55 | 1.45 | 0.7 | 8 | — | 0.7 | — |
| D | 0.55 | 1.45 | 0.7 | 5 | — | 0.7 | 0.3 |
| E | 0.55 | 1.45 | 0.7 | 4 | — | 0.7 | 0.05 |
| F | 0.6 | 2.0 | 0.7 | 5 | 0.2 | 1.0 | 2.0 |
| G | 0.55 | 1.45 | 0.7 | 7 | — | 0.7 | — |
| H | 0.55 | 1.45 | 0.7 | 12 | — | 0.7 | — |
| I | 0.6 | 2.0 | 0.7 | 6 | 0.2 | 1.0 | — |

The above-mentioned molten steel was cast into a mold that cools at the same rate as the actual machine. The resulting ingot underwent soaking, blooming, and hot rolling. Thus there was obtained a wire, 8.0 mm in diameter. Table 2 below shows the condition of hot rolling together with the basicity for sample Nos. 1 to 9.

TABLE 2

| Sample No. | Steel Designation | Slag basicity | Conditions of hot rolling |
|---|---|---|---|
| 1 | A | 0.84 | 1280° C. × 5 h soaking → blooming → hot rolling at 1000° C. |
| 2 | B | 1.2 | 1280° C. × 5 h soaking → blooming → hot rolling at 1000° C. |
| 3 | C | 1.8 | 1280° C. × 5 h soaking → blooming → hot rolling at 1000° C. |
| 4 | D | 0.79 | 1280° C. × 1 h soaking → blooming → hot rolling at 1000° C. |
| 5 | E | 0.85 | 1280° C. × 1 h soaking → blooming → hot rolling at 1000° C. |
| 6 | F | 0.90 | 1280° C. × 1 h soaking → blooming → hot rolling at 1000° C. |
| 7 | G | 0.81 | 1280° C. × 1 h soaking → blooming → hot rolling at 1000° C. |
| 8 | H | 1.70 | 1280° C. × 1 h soaking → blooming → hot rolling at 1000° C. |
| 9 | I | 0.72 | 1280° C. × 5 h soaking → blooming → hot rolling at 1000° C. |

The samples of hot rolled wire thus obtained were examined for the composition of inclusions therein and also tested for fatigue strength as follows.

Composition of Inclusions

Each wire sample was cut longitudinally and its cross section containing its axis was polished. The cross section was examined to pick up 30 oxide inclusions (larger than 3 μm in short axis) which are present outside one quarter of diameter (or one half of radius). The oxide inclusions were analyzed by EPMA and the results of analysis were converted into the concentration of oxides.

Fatigue Strength

The hot-rolled wire (8.0 mmϕ) underwent peeling, patenting, cold drawing, oil tempering, treatment equivalent to strain relief annealing, shot peening, and strain relief annealing. A test piece measuring 4.0 mm in diameter and 650 mm in length was taken. It was subjected to bend test with Nakamura-type rotating bending fatigue tester under the following conditions.

Stress 880 MPa (nominal)

Rotating speed: 4000-5000 rpm

Number of bending cycles: $2\times10^7$

The fracture ratio was calculated from the following formula for those samples which broke due to inclusions. The broken samples were examined for the size of the inclusions that appeared on the surface of rupture.

$$\text{Ration of failure}=[A/(A+B)]\times100\%$$

(where A denotes the number of the samples which broke due to inclusions, and B denotes the number of the samples not fractured after $2\times10^7$ bending cycles).

Table 3 below shows the fracture ratio and the size of inclusions observed on the rupture surface.

Figure 2:
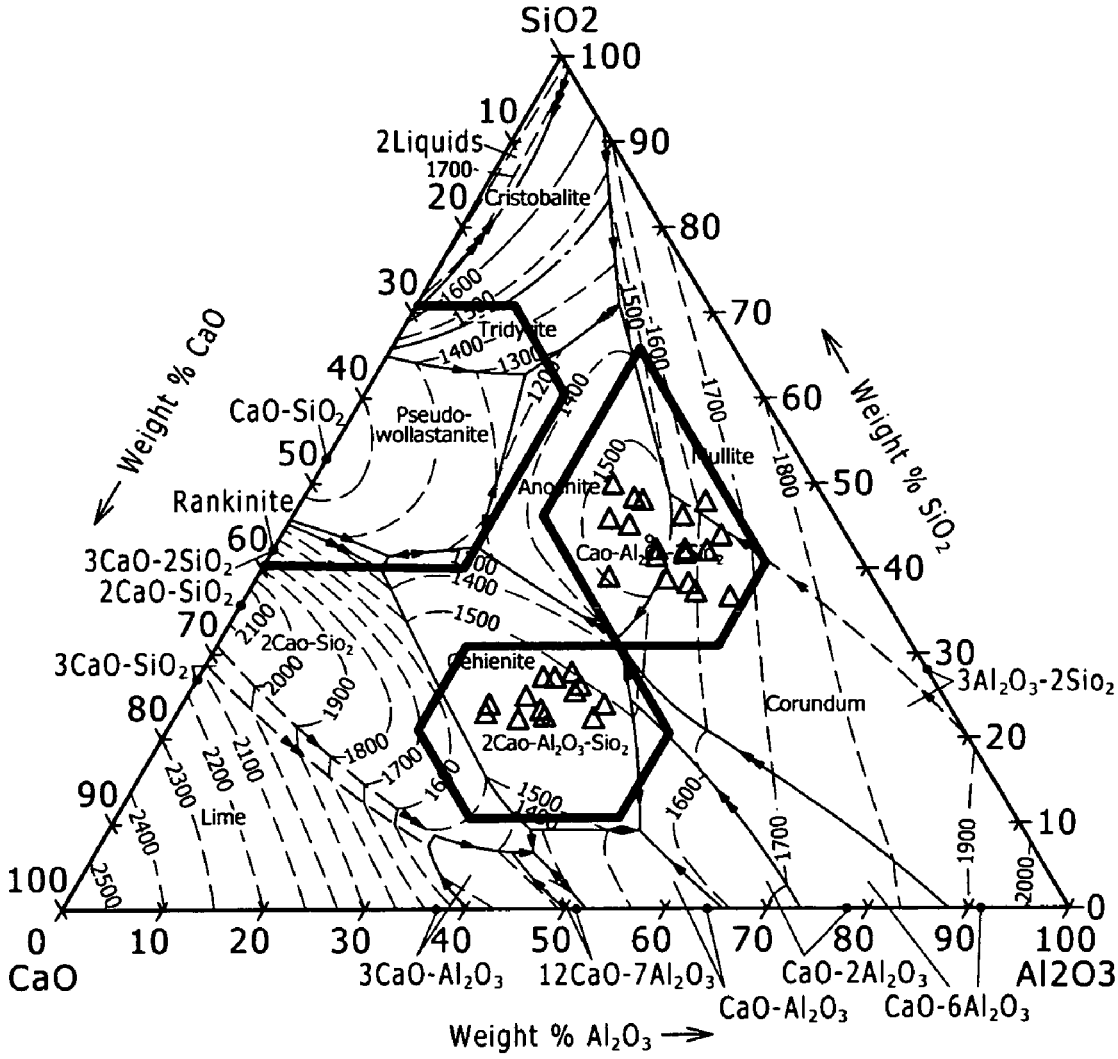
FIG. 2 is the composition distribution of inclusions in the specimen No. 2 in CaO—$Al_2O_3$—$SiO_2$ ternary phase diagram.
Figure 3:
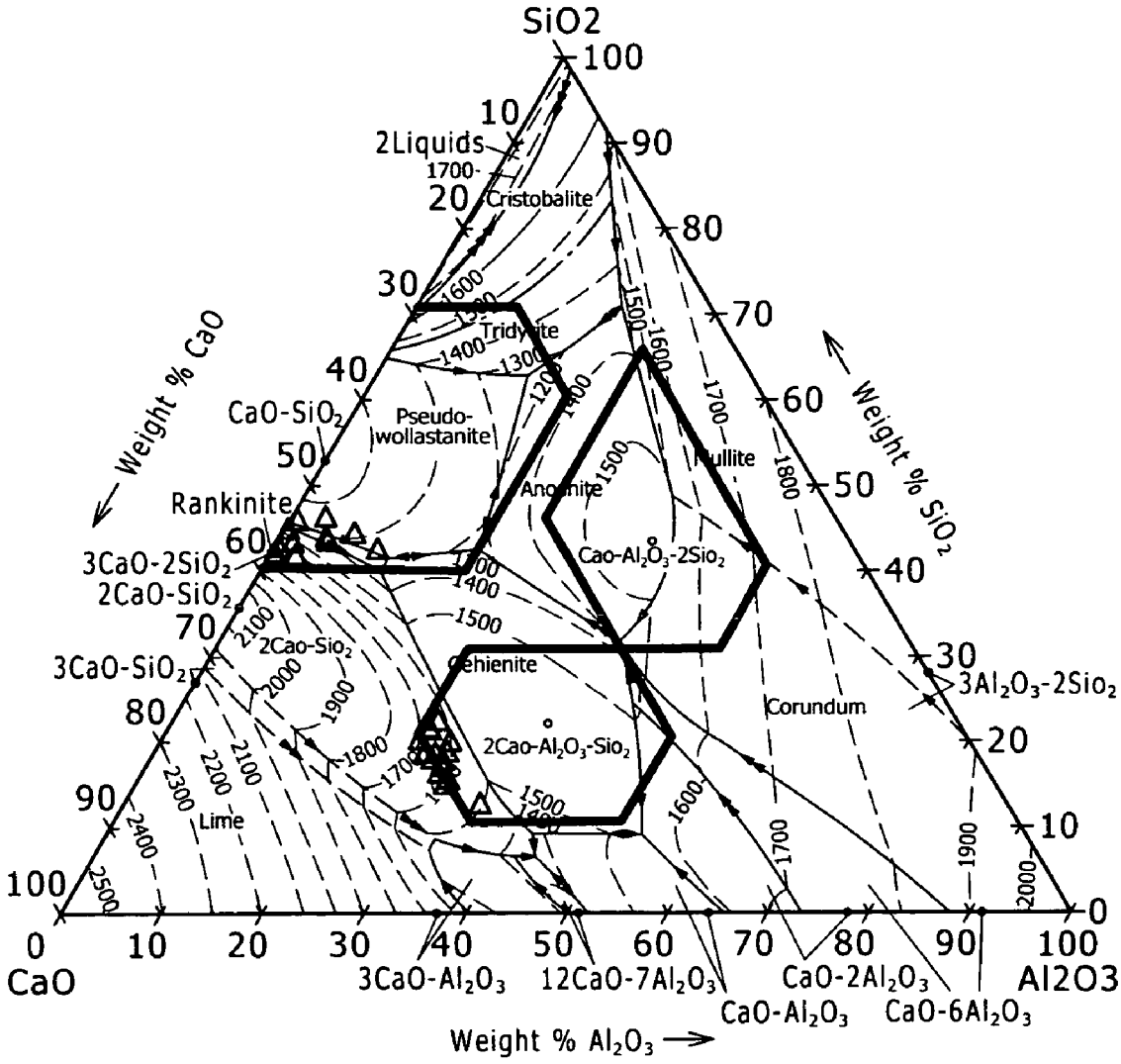
FIG. 3 is the composition distribution of inclusions in the specimen No. 3 in CaO—$Al_2O_3$—$SiO_2$ ternary phase diagram.
Figure 4:
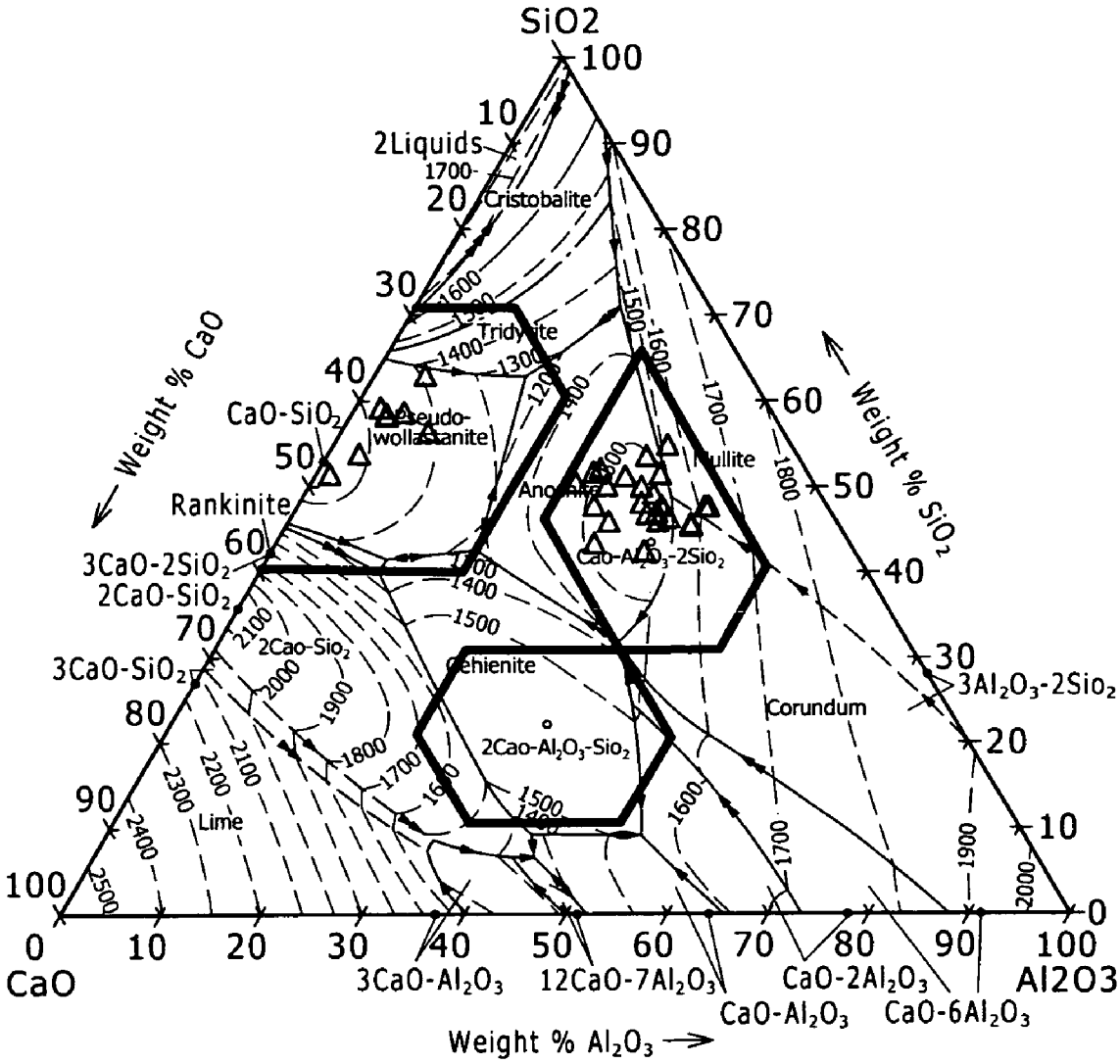
FIG. 4 is the composition distribution of inclusions in the specimen No. 4 in CaO—$Al20_3$—$SiO_2$ ternary phase diagram.
Figure 5:
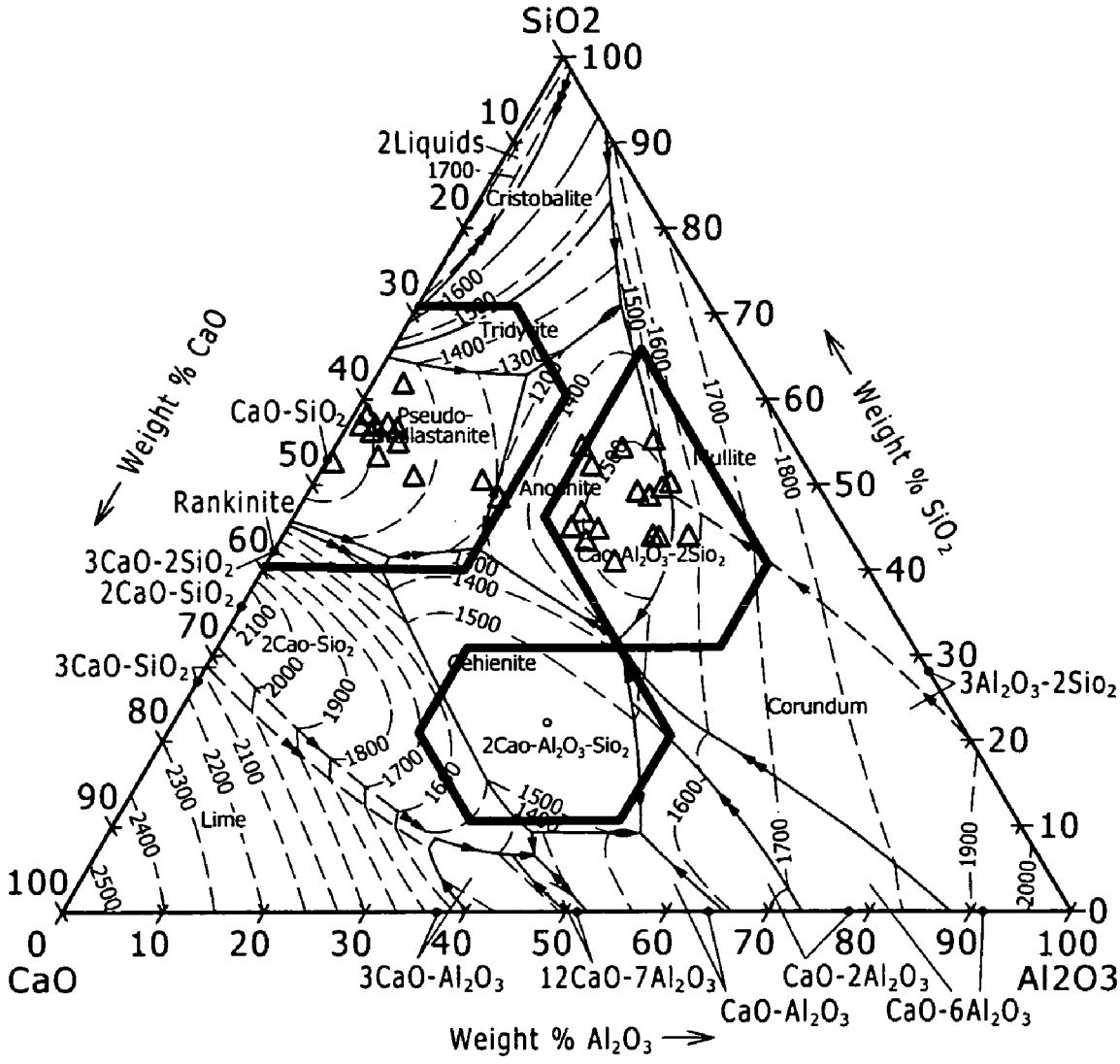
FIG. 5 is the composition distribution of inclusions in the specimen No. 5 in CaO—$Al_2O_3$—$SiO_2$ ternary phase diagram.
Figure 6:
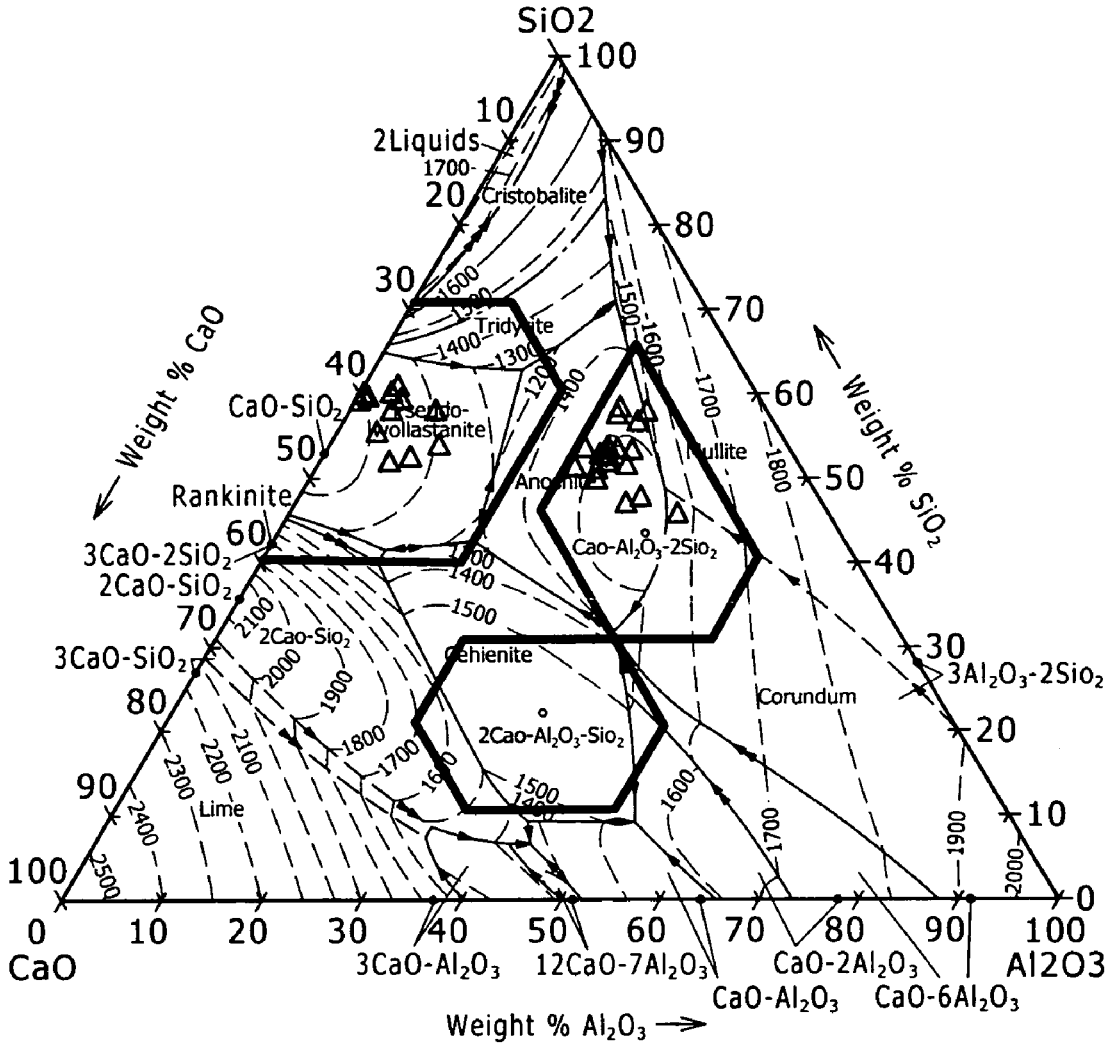
FIG. 6 is the composition distribution of inclusions in the specimen No. 6 in CaO—$Al_2O_3$—$SiO_2$ ternary phase diagram.
Figure 7:
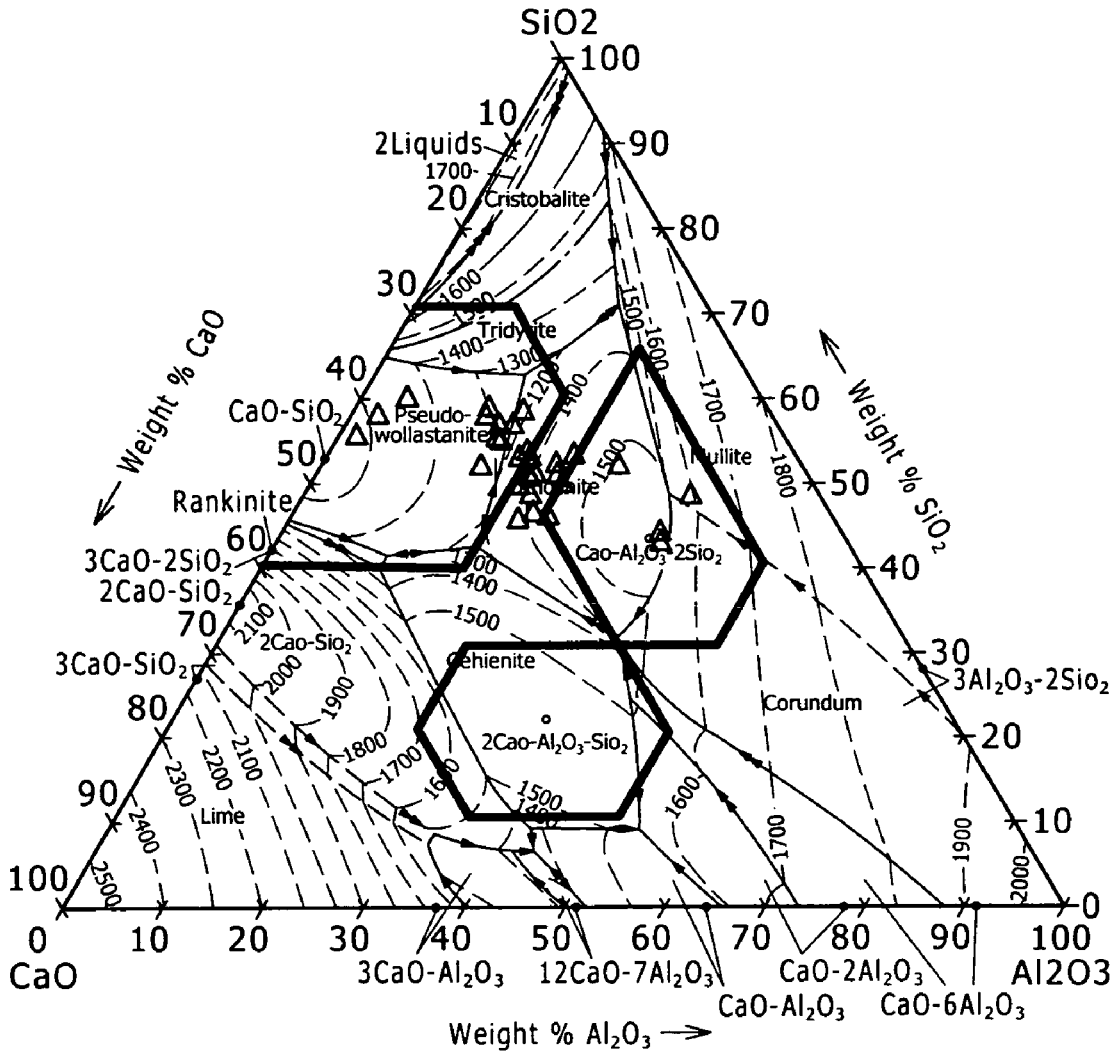
FIG. 7 is the composition distribution of inclusions in the specimen No. 7 in CaO—$Al_2O_3$—$SiO_2$ ternary phase diagram.
Figure 8:
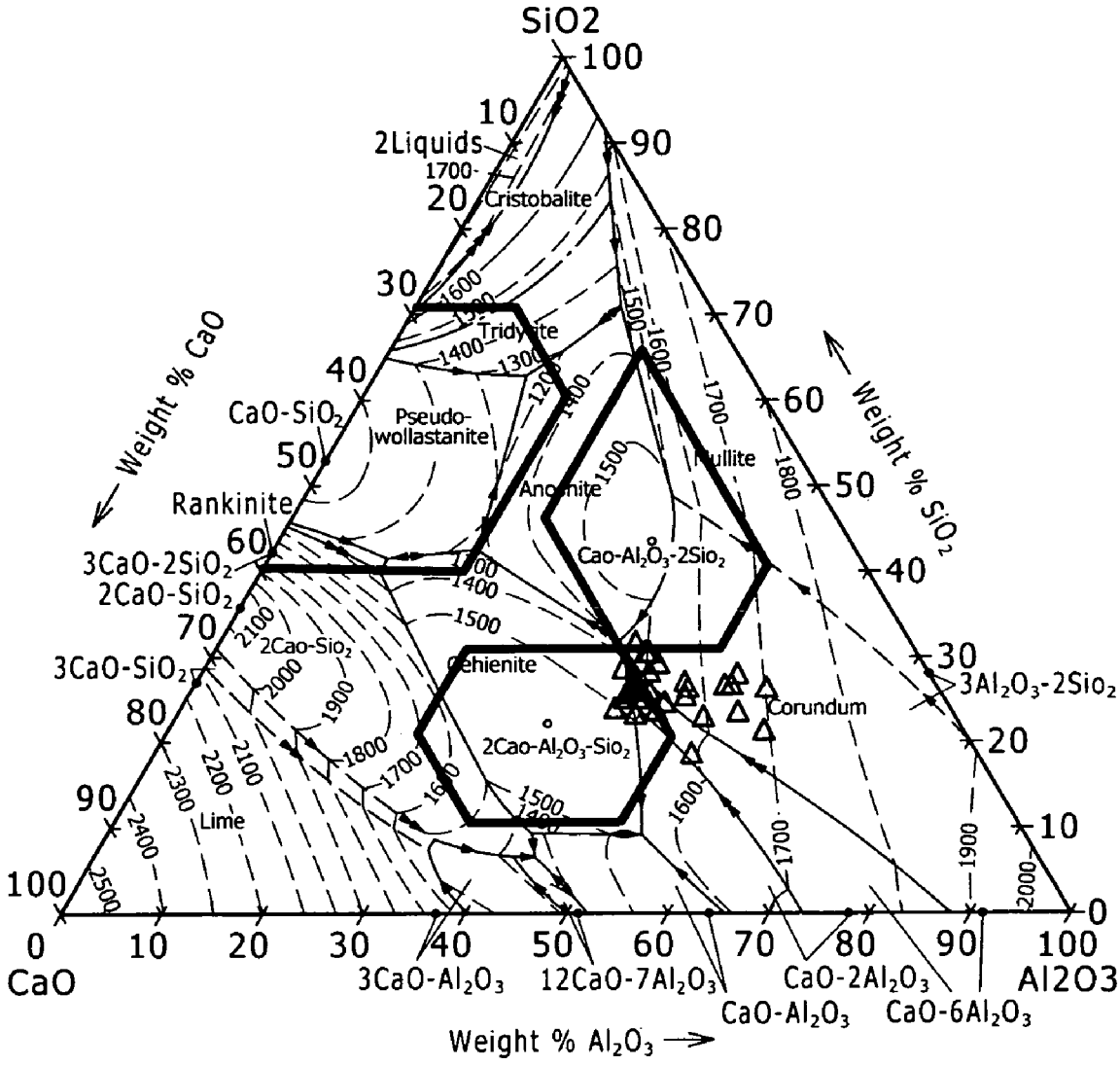
FIG. 8 is the composition distribution of inclusions in the specimen No. 8 in CaO—$Al_2O_3$—$SiO_2$ ternary phase diagram.
Figure 9:
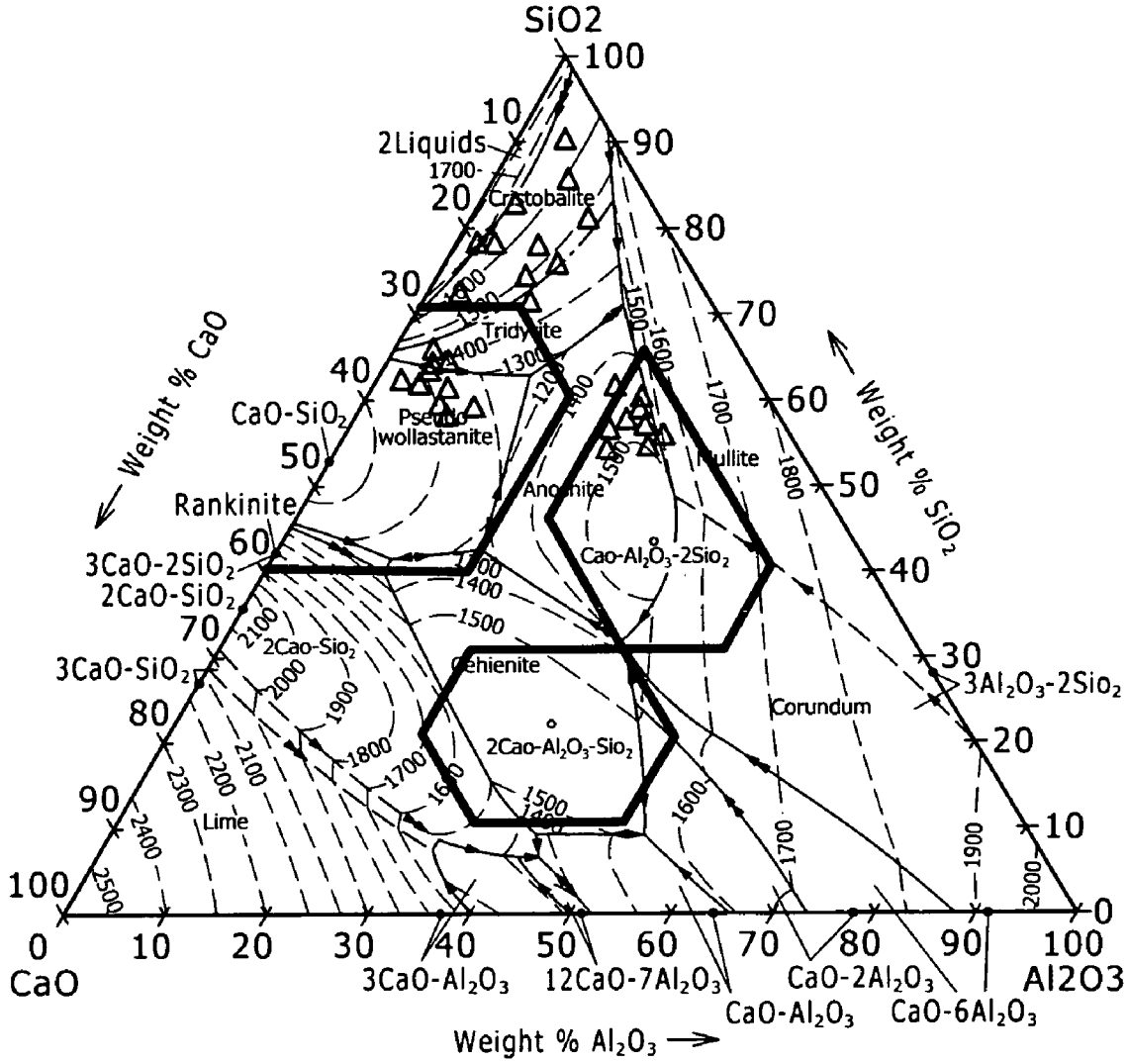
FIG. 9 is the composition distribution of inclusions in the specimen No. 9 in CaO—$Al_2O_3$—$SiO_2$ ternary phase diagram.

Tables 4 to 12 below show the composition of inclusions in each wire sample. FIGS. 1 to 9 show the composition distribution of inclusions represented in terms of $SiO_2$—$Al_2O_3$—CaO ternary phase diagram according to the results shown in Tables 4 to 12.

TABLE 3

| Sample No. | Steel designation | Fracture ratio (%) | Maximum size of inclusions on surface of rupture |
|---|---|---|---|
| 1 | A | 6 | 22.4 |
| 2 | B | 15 | 25.0 |
| 3 | C | 12 | 24.5 |
| 4 | D | 1 | 14.3 |
| 5 | E | 3 | 15.2 |
| 6 | F | 0 | 13.2 |
| 7 | G | 36 | 33.5 |
| 8 | H | 39 | 41.2 |
| 9 | I | 53 | 47.1 |

TABLES 4

| Composition of Inclusions in Sample No. 1 (mass %) | | | | |
|---|---|---|---|---|
| CaO | $Al_2O_3$ | $SiO_2$ | MnO | MgO |
| 12.2 | 35.7 | 48.2 | 3.7 | 0.3 |
| 30.1 | 4.6 | 61.9 | 2.0 | 1.3 |
| 11.1 | 32.7 | 53.0 | 1.7 | 1.5 |
| 12.3 | 35.4 | 49.1 | 2.9 | 0.4 |
| 13.7 | 36.0 | 47.8 | 1.9 | 0.5 |
| 12.4 | 35.9 | 47.1 | 2.4 | 2.4 |
| 11.8 | 35.0 | 49.6 | 3.6 | 0.0 |
| 13.7 | 35.8 | 47.3 | 2.7 | 0.5 |
| 16.9 | 37.0 | 44.2 | 0.7 | 1.2 |
| 15.1 | 39.0 | 45.2 | 0.7 | 0.0 |
| 12.9 | 35.0 | 46.9 | 2.7 | 2.4 |
| 33.2 | 1.8 | 58.9 | 3.1 | 2.9 |
| 13.8 | 38.3 | 44.5 | 3.4 | 0.0 |
| 10.5 | 35.1 | 49.6 | 4.8 | 0.0 |
| 12.5 | 31.7 | 50.5 | 2.1 | 3.2 |
| 12.9 | 34.7 | 46.2 | 5.0 | 1.1 |
| 15.9 | 33.7 | 46.2 | 2.7 | 1.5 |
| 13.0 | 35.5 | 47.8 | 2.3 | 1.3 |
| 15.6 | 31.8 | 48.0 | 2.7 | 1.9 |
| 14.4 | 36.9 | 46.1 | 1.5 | 1.0 |
| 12.7 | 37.2 | 47.4 | 1.8 | 0.9 |
| 15.8 | 35.2 | 46.9 | 1.9 | 0.2 |
| 13.3 | 35.5 | 48.2 | 1.5 | 1.5 |
| 33.6 | 7.7 | 55.2 | 0.7 | 2.9 |
| 35.5 | 6.0 | 54.8 | 2.0 | 1.6 |
| 11.0 | 32.6 | 50.2 | 4.4 | 1.9 |
| 12.5 | 34.5 | 50.0 | 3.0 | 0.0 |
| 30.0 | 5.5 | 60.2 | 1.2 | 3.2 |
| 32.2 | 4.3 | 59.2 | 1.4 | 2.9 |
| 38.1 | 5.3 | 53.6 | 1.0 | 2.0 |

TABLES 5

| Composition of Inclusions in Sample No. 2 (mass %) | | | | |
|---|---|---|---|---|
| CaO | $Al_2O_3$ | $SiO_2$ | MnO | MgO |
| 14.5 | 42.9 | 40.2 | 0.0 | 2.4 |
| 15.1 | 48.2 | 34.9 | 1.8 | 0.0 |
| 17.5 | 43.1 | 34.7 | 1.4 | 3.3 |
| 12.3 | 43.6 | 42.1 | 0.8 | 1.2 |
| 18.1 | 42.8 | 36.5 | 0.5 | 2.1 |
| 16.8 | 40.9 | 40.1 | 0.2 | 2.0 |
| 19.5 | 39.4 | 35.9 | 2.8 | 2.4 |
| 11.3 | 38.8 | 44.6 | 2.1 | 3.2 |
| 14.6 | 37.8 | 43.7 | 0.7 | 3.2 |
| 19.4 | 37.4 | 38.9 | 1.2 | 3.1 |
| 18.7 | 36.8 | 39.1 | 2.7 | 2.7 |
| 24.6 | 33.3 | 35.5 | 3.9 | 2.7 |
| 17.6 | 33.5 | 45.6 | 1.3 | 2.0 |
| 18.6 | 32.9 | 46.1 | 2.4 | 0.0 |
| 22.5 | 31.7 | 44.1 | 0.5 | 1.3 |
| 19.2 | 29.0 | 46.7 | 1.8 | 3.3 |

TABLES 5-continued

Composition of Inclusions in Sample No. 2 (mass %)

| CaO | $Al_2O_3$ | $SiO_2$ | MnO | MgO |
|---|---|---|---|---|
| 19.5 | 31.5 | 40.3 | 6.0 | 2.7 |
| 33.7 | 41.9 | 22.5 | 1.9 | 0.0 |
| 35.0 | 40.5 | 20.3 | 2.7 | 1.5 |
| 35.2 | 38.4 | 24.6 | 1.8 | 0.0 |
| 34.9 | 37.2 | 23.2 | 1.5 | 3.2 |
| 35.0 | 36.7 | 26.0 | 2.3 | 0.0 |
| 40.5 | 36.6 | 21.1 | 0.7 | 1.1 |
| 39.1 | 34.7 | 21.1 | 2.7 | 2.4 |
| 36.5 | 34.8 | 25.2 | 3.1 | 0.4 |
| 42.3 | 33.6 | 20.1 | 2.7 | 1.3 |
| 36.0 | 32.1 | 24.0 | 5.6 | 2.3 |
| 40.1 | 32.7 | 22.8 | 1.5 | 2.9 |
| 45.1 | 30.0 | 21.0 | 3.4 | 0.5 |
| 45.0 | 30.4 | 22.5 | 2.1 | 0.0 |

TABLES 6

Composition of Inclusions in Sample No. 3 (mass %)

| CaO | $Al_2O_3$ | $SiO_2$ | MnO | MgO |
|---|---|---|---|---|
| 55.6 | 0.0 | 41.3 | 1.8 | 1.3 |
| 52.3 | 27.1 | 17.2 | 2.3 | 1.1 |
| 54.3 | 2.3 | 40.1 | 1.7 | 1.6 |
| 53.3 | 26.1 | 17.6 | 2.0 | 1.0 |
| 53.6 | 0.1 | 43.3 | 1.5 | 1.5 |
| 57.2 | 0.5 | 42.3 | 0.0 | 0.0 |
| 55.1 | 1.4 | 42.6 | 0.7 | 0.2 |
| 51.6 | 25.3 | 20.5 | 0.3 | 2.3 |
| 54.9 | 0.3 | 41.2 | 3.3 | 0.3 |
| 46.8 | 10.0 | 41.6 | 1.2 | 0.4 |
| 52.1 | 0.5 | 44.1 | 3.3 | 0.0 |
| 55.9 | 0.3 | 41.2 | 1.4 | 1.2 |
| 50.4 | 4.3 | 42.5 | 2.3 | 0.5 |
| 47.6 | 3.0 | 43.3 | 5.6 | 0.6 |
| 53.9 | 27.5 | 17.3 | 1.0 | 0.3 |
| 53.1 | 28.4 | 15.2 | 1.2 | 2.1 |
| 53.6 | 28.3 | 15.6 | 1.3 | 1.2 |
| 53.6 | 30.2 | 13.9 | 1.2 | 1.1 |
| 52.2 | 28.5 | 16.4 | 1.7 | 1.2 |
| 50.1 | 25.5 | 21.3 | 1.8 | 1.3 |
| 53.1 | 25.0 | 18.7 | 2.1 | 1.1 |
| 51.6 | 28.0 | 15.7 | 2.2 | 2.5 |
| 51.0 | 25.1 | 20.1 | 2.2 | 1.6 |
| 50.1 | 27.6 | 17.5 | 3.5 | 1.3 |
| 48.1 | 27.0 | 18.2 | 4.3 | 2.4 |
| 48.2 | 7.0 | 43.7 | 1.1 | 0.0 |
| 52.1 | 29.7 | 13.9 | 3.3 | 1.0 |
| 51.3 | 34.6 | 11.5 | 0.3 | 2.3 |
| 55.9 | 0.1 | 40.2 | 3.6 | 0.2 |
| 50.3 | 4.5 | 42.1 | 1.9 | 1.2 |

TABLES 7

Composition of Inclusions in Sample No. 4 (mass %)

| CaO | $Al_2O_3$ | $SiO_2$ | MnO | MgO |
|---|---|---|---|---|
| 16.5 | 35.7 | 45.9 | 1.9 | 0.0 |
| 18.2 | 34.5 | 44.7 | 2.5 | 0.1 |
| 16.3 | 33.1 | 45.8 | 1.4 | 3.4 |
| 11.9 | 31.0 | 50.2 | 2.8 | 4.1 |
| 24.0 | 29.7 | 39.6 | 4.3 | 2.4 |
| 20.1 | 28.3 | 46.5 | 0.3 | 4.8 |
| 19.6 | 26.5 | 48.2 | 1.9 | 3.8 |
| 20.2 | 26.0 | 47.7 | 3.5 | 2.6 |
| 22.7 | 25.0 | 46.9 | 3.4 | 2.0 |
| 22.5 | 28.0 | 44.5 | 4.0 | 1.0 |
| 47.7 | 1.5 | 49.9 | 0.8 | 0.1 |
| 37.9 | 3.5 | 56.1 | 1.3 | 1.2 |

TABLES 7-continued

Composition of Inclusions in Sample No. 4 (mass %)

| CaO | $Al_2O_3$ | $SiO_2$ | MnO | MgO |
|---|---|---|---|---|
| 34.0 | 8.3 | 52.9 | 1.7 | 3.1 |
| 42.6 | 3.0 | 51.4 | 2.0 | 1.0 |
| 35.3 | 4.9 | 55.1 | 2.1 | 2.6 |
| 36.9 | 2.4 | 55.1 | 3.4 | 2.2 |
| 30.7 | 4.9 | 58.1 | 4.1 | 2.2 |
| 18.0 | 33.0 | 45.2 | 2.6 | 1.2 |
| 14.6 | 30.1 | 49.6 | 4.2 | 1.5 |
| 14.8 | 33.2 | 48.7 | 2.0 | 1.3 |
| 18.1 | 30.0 | 48.6 | 3.3 | 0.0 |
| 17.3 | 32.2 | 47.5 | 1.8 | 1.2 |
| 11.9 | 39.5 | 45.4 | 2.2 | 1.0 |
| 11.8 | 39.4 | 45.0 | 3.8 | 0.0 |
| 17.3 | 36.1 | 45.4 | 1.2 | 0.0 |
| 16.0 | 36.1 | 43.5 | 2.5 | 1.9 |
| 17.4 | 35.6 | 43.4 | 2.2 | 1.4 |
| 22.7 | 31.7 | 44.5 | 0.5 | 0.6 |
| 14.4 | 39.3 | 43.0 | 2.1 | 1.2 |
| 21.3 | 37.3 | 41.4 | 0.0 | 0.0 |

TABLES 8

Composition of Inclusions in Sample No. 1 (mass %)

| CaO | $Al_2O_3$ | $SiO_2$ | MnO | MgO |
|---|---|---|---|---|
| 30.7 | 18.9 | 47.3 | 1.9 | 1.2 |
| 18.5 | 35.5 | 43.5 | 2.2 | 0.3 |
| 40.2 | 4.6 | 51.8 | 1.7 | 1.7 |
| 31.4 | 16.5 | 49.1 | 2.7 | 0.3 |
| 39.1 | 1.3 | 57.3 | 1.1 | 1.2 |
| 40.1 | 2.8 | 55.1 | 1.7 | 0.3 |
| 16.2 | 32.2 | 46.3 | 2.2 | 3.1 |
| 32.4 | 3.1 | 58.1 | 3.1 | 3.3 |
| 36.2 | 5.2 | 54.7 | 1.5 | 2.4 |
| 18.1 | 36.2 | 43.1 | 2.4 | 0.2 |
| 23.6 | 30.0 | 44.6 | 1.6 | 0.2 |
| 40.1 | 1.4 | 55.4 | 2.1 | 1.0 |
| 16.4 | 32.8 | 47.5 | 2.1 | 1.2 |
| 37.1 | 3.7 | 55.3 | 1.3 | 2.6 |
| 38.2 | 9.6 | 50.3 | 1.8 | 0.1 |
| 13.9 | 33.9 | 48.9 | 0.0 | 3.3 |
| 16.3 | 27.3 | 53.1 | 1.2 | 2.1 |
| 37.1 | 2.6 | 53.1 | 2.1 | 5.1 |
| 45.2 | 0.9 | 50.1 | 1.2 | 2.6 |
| 15.1 | 34.1 | 49.3 | 0.6 | 0.9 |
| 19.8 | 25.0 | 50.1 | 1.9 | 3.2 |
| 37.4 | 5.9 | 53.2 | 1.9 | 1.6 |
| 15.1 | 38.9 | 43.5 | 0.3 | 2.2 |
| 17.2 | 31.5 | 48.1 | 2.2 | 1.0 |
| 23.4 | 32.7 | 40.1 | 1.9 | 1.9 |
| 20.2 | 23.6 | 53.6 | 1.4 | 1.2 |
| 12.6 | 29.5 | 53.4 | 2.5 | 2.0 |
| 25.9 | 30.2 | 43.8 | 0.1 | 0.0 |
| 26.4 | 27.5 | 45.1 | 0.6 | 0.4 |
| 24.6 | 27.8 | 46.9 | 0.4 | 0.3 |

TABLES 9

Composition of Inclusions in Sample No. 6 (mass %)

| CaO | $Al_2O_3$ | $SiO_2$ | MnO | MgO |
|---|---|---|---|---|
| 34.5 | 10.6 | 50.5 | 3.4 | 1.0 |
| 15.1 | 26.5 | 53.9 | 1.3 | 3.2 |
| 40.1 | 0.6 | 55.8 | 2.2 | 1.3 |
| 38.4 | 8.6 | 49.7 | 1.8 | 1.5 |
| 40.8 | 6.9 | 49.3 | 2.0 | 1.0 |
| 38.2 | 0.9 | 55.2 | 3.1 | 2.6 |
| 17.7 | 29.2 | 51.6 | 1.5 | 0.0 |
| 33.3 | 8.4 | 55.3 | 1.9 | 1.1 |

TABLES 9-continued

| Composition of Inclusions in Sample No. 6 (mass %) | | | | |
|---|---|---|---|---|
| CaO | $Al_2O_3$ | $SiO_2$ | MnO | MgO |
| 36.3 | 3.0 | 56.8 | 1.3 | 2.6 |
| 14.5 | 25.8 | 54.3 | 3.3 | 2.1 |
| 15.3 | 38.5 | 43.2 | 1.5 | 1.5 |
| 21.5 | 28.9 | 47.6 | 1.7 | 0.3 |
| 35.1 | 3.3 | 57.6 | 1.9 | 2.1 |
| 18.7 | 27.7 | 50.1 | 1.2 | 2.3 |
| 34.8 | 4.4 | 54.3 | 3.4 | 3.1 |
| 39.3 | 0.4 | 56.7 | 2.1 | 1.5 |
| 12.3 | 29.6 | 55.2 | 0.3 | 2.6 |
| 16.3 | 30.5 | 50.9 | 2.1 | 0.2 |
| 37.8 | 4.1 | 55.1 | 0.8 | 2.2 |
| 22.3 | 25.2 | 47.9 | 2.3 | 2.3 |
| 18.2 | 28.0 | 51.3 | 1.3 | 1.2 |
| 40.1 | 3.8 | 52.3 | 1.7 | 2.1 |
| 13.2 | 28.3 | 52.1 | 3.3 | 3.1 |
| 18.1 | 34.2 | 45.7 | 0.7 | 1.3 |
| 20.3 | 25.1 | 50.2 | 1.2 | 3.2 |
| 19.1 | 26.0 | 45.2 | 5.6 | 4.1 |
| 19.4 | 28.4 | 48.3 | 1.9 | 2.0 |
| 20.1 | 33.0 | 44.8 | 0.0 | 2.1 |
| 17.5 | 30.7 | 48.7 | 2.1 | 1.0 |
| 19.4 | 27.3 | 50.1 | 1.3 | 1.9 |

TABLES 10

| Composition of Inclusions in Sample No. 7 (mass %) | | | | |
|---|---|---|---|---|
| CaO | $Al_2O_3$ | $SiO_2$ | MnO | MgO |
| 40.5 | 1.8 | 51.4 | 4.7 | 1.6 |
| 35.8 | 2.6 | 51.7 | 5.5 | 4.4 |
| 33.5 | 4.4 | 55.2 | 3.8 | 3.1 |
| 24.4 | 11.6 | 50.2 | 6.1 | 7.7 |
| 27.4 | 13.0 | 53.6 | 5.6 | 0.4 |
| 25.8 | 14.3 | 51.2 | 6.1 | 2.6 |
| 30.2 | 14.9 | 47.2 | 5.6 | 2.1 |
| 27.6 | 15.2 | 51.5 | 3.3 | 2.4 |
| 28.0 | 15.9 | 52.3 | 3.6 | 0.2 |
| 26.7 | 16.6 | 55.3 | 1.1 | 0.3 |
| 23.5 | 15.8 | 53.6 | 4.7 | 2.4 |
| 25.8 | 17.8 | 47.5 | 1.2 | 7.7 |
| 25.9 | 18.9 | 50.4 | 4.2 | 0.6 |
| 26.5 | 21.0 | 50.7 | 1.3 | 0.5 |
| 30.1 | 21.5 | 42.3 | 5.5 | 0.6 |
| 28.8 | 20.0 | 46.9 | 4.3 | 0.0 |
| 26.5 | 20.1 | 46.7 | 3.1 | 3.6 |
| 26.7 | 21.0 | 48.3 | 2.7 | 1.3 |
| 27.1 | 21.9 | 49.2 | 1.3 | 0.5 |
| 27.9 | 21.5 | 45.5 | 4.6 | 0.5 |
| 23.3 | 22.2 | 48.6 | 5.6 | 0.3 |
| 29.1 | 23.2 | 44.3 | 3.2 | 0.2 |
| 24.4 | 23.2 | 48.2 | 0.9 | 3.3 |
| 20.4 | 22.5 | 47.9 | 4.1 | 5.1 |
| 23.5 | 23.2 | 45.5 | 6.1 | 1.7 |
| 28.9 | 25.6 | 45.2 | 0.0 | 0.3 |
| 18.1 | 28.8 | 49.6 | 3.2 | 0.3 |
| 18.5 | 38.0 | 43.5 | 0.0 | 0.0 |
| 18.6 | 37.3 | 40.8 | 1.7 | 1.6 |
| 12.9 | 38.4 | 47.0 | 1.3 | 0.4 |

TABLES 11

| Composition of Inclusions in Sample No. 8 (mass %) | | | | |
|---|---|---|---|---|
| CaO | $Al_2O_3$ | $SiO_2$ | MnO | MgO |
| 18.6 | 54.5 | 19.3 | 7.6 | 0.0 |
| 21.2 | 54.8 | 22.8 | 0.9 | 0.5 |
| 16.9 | 55.0 | 25.1 | 1.2 | 1.8 |
| 19.7 | 50.9 | 25.2 | 1.4 | 2.8 |

TABLES 11-continued

| Composition of Inclusions in Sample No. 8 (mass %) | | | | |
|---|---|---|---|---|
| CaO | $Al_2O_3$ | $SiO_2$ | MnO | MgO |
| 27.6 | 51.0 | 17.6 | 0.6 | 3.2 |
| 17.5 | 48.4 | 25.4 | 6.0 | 2.7 |
| 20.7 | 51.3 | 25.9 | 2.1 | 0.0 |
| 24.6 | 50.2 | 21.9 | 0.8 | 2.5 |
| 24.1 | 45.9 | 23.7 | 5.2 | 1.1 |
| 23.9 | 46.8 | 25.0 | 0.5 | 3.8 |
| 25.1 | 47.8 | 24.8 | 0.2 | 2.1 |
| 23.9 | 45.6 | 25.4 | 1.9 | 3.2 |
| 27.0 | 44.7 | 23.2 | 1.8 | 3.3 |
| 28.6 | 44.6 | 22.3 | 2.5 | 2.4 |
| 27.6 | 42.9 | 24.3 | 1.9 | 3.3 |
| 30.2 | 42.7 | 21.9 | 1.8 | 3.4 |
| 24.5 | 40.8 | 26.4 | 3.0 | 5.3 |
| 28.3 | 40.7 | 22.7 | 7.9 | 0.4 |
| 26.8 | 42.0 | 26.8 | 0.2 | 4.2 |
| 29.1 | 41.1 | 23.9 | 2.7 | 3.2 |
| 29.4 | 41.4 | 24.6 | 0.8 | 3.8 |
| 29.5 | 40.8 | 24.2 | 3.6 | 1.9 |
| 30.6 | 40.9 | 23.4 | 0.6 | 4.5 |
| 30.4 | 41.2 | 24.2 | 2.1 | 2.1 |
| 30.7 | 42.1 | 25.0 | 0.2 | 2.0 |
| 25.6 | 40.6 | 28.6 | 1.9 | 3.3 |
| 32.1 | 40.5 | 22.4 | 0.9 | 4.1 |
| 25.9 | 40.8 | 29.0 | 2.0 | 2.3 |
| 28.9 | 38.8 | 26.8 | 1.0 | 4.5 |
| 26.5 | 39.2 | 30.4 | 1.6 | 2.3 |

TABLES 12

| Composition of Inclusions in Sample No. 9 (mass %) | | | | |
|---|---|---|---|---|
| CaO | $Al_2O_3$ | $SiO_2$ | MnO | MgO |
| 14.0 | 8.2 | 75.0 | 1.5 | 1.3 |
| 13.2 | 11.0 | 73.2 | 0.0 | 2.6 |
| 17.2 | 8.9 | 73.0 | 0.8 | 0.1 |
| 18.1 | 10.6 | 70.0 | 0.3 | 1.0 |
| 19.2 | 2.0 | 73.2 | 3.3 | 2.3 |
| 18.3 | 3.9 | 76.4 | 1.2 | 0.2 |
| 7.2 | 7.3 | 82.1 | 3.3 | 0.2 |
| 24.2 | 3.1 | 69.5 | 2.1 | 1.1 |
| 13.4 | 3.4 | 77.4 | 4.2 | 1.6 |
| 12.6 | 30.9 | 53.5 | 2.0 | 1.0 |
| 14.9 | 26.1 | 54.1 | 3.4 | 1.5 |
| 17.2 | 22.7 | 53.9 | 2.7 | 3.5 |
| 19.1 | 24.0 | 52.4 | 2.2 | 2.3 |
| 13.2 | 27.8 | 53.1 | 3.3 | 2.6 |
| 14.4 | 30.1 | 52.1 | 1.4 | 2.0 |
| 32.1 | 9.4 | 55.1 | 2.3 | 1.1 |
| 32.4 | 2.3 | 56.7 | 4.1 | 4.5 |
| 34.2 | 3.1 | 58.9 | 1.9 | 1.9 |
| 32.4 | 6.0 | 57.6 | 3.1 | 0.9 |
| 29.6 | 8.4 | 56.4 | 3.2 | 2.4 |
| 29.4 | 11.1 | 57.2 | 1.8 | 0.5 |
| 31.2 | 2.1 | 62.3 | 2.9 | 1.5 |
| 30.1 | 4.3 | 63.3 | 1.7 | 0.6 |
| 28.4 | 7.7 | 60.1 | 2.5 | 1.3 |
| 31.2 | 2.3 | 59.1 | 3.9 | 3.5 |
| 13.2 | 27.0 | 55.3 | 1.9 | 2.6 |
| 12.1 | 26.0 | 56.1 | 3.4 | 2.4 |
| 13.4 | 22.2 | 55.4 | 1.3 | 7.7 |
| 5.3 | 3.2 | 86.1 | 2.2 | 3.2 |
| 7.6 | 7.8 | 80.1 | 3.8 | 0.7 |

It is concluded as follows from the foregoing. Samples Nos. 1 to 3 showed adequate fatigue strength because of the adequately controlled slag basicity and hot rolling under adequate conditions, and the composition of inclusions separates into two regions. Samples Nos. 4 to 6 also showed adequate fatigue strength because the adequately controlled slag basicity and the addition of Li despite short soaking, and the composition of inclusions separates into two regions.

By contrast, samples Nos. 7 and 8 gave poor results in fatigue test because of the short soaking time and insufficient phase separation, and the composition of inclusions does not separate into two regions. Sample No. 9 gave poor results in fatigue test because of the low slag basicity and phase separation (which produced inclusions with a high $SiO_2$ content).

What is claimed is:

1. An ultra clean spring steel provided in the form of a wire, wherein:

the wire comprises oxide inclusions with a sulfur concentration no more than 10 mass %;

no less than 70% of the inclusions, in terms of numbers, that exist in an outer layer outside one quarter of a diameter of the wire and have a width no smaller than 3 μm, satisfy formula (1)

$$CaO+Al_2O_3+SiO_2+MnO+MgO>80\text{mass \%} \quad (1)$$

and satisfy two or three of formulae (A) to (C)

(A) $SiO_2$:40-70 mass %, $Al_2O_3$: 0-20 mass %, CaO: 20-60 mass %;

(B) $SiO_2$: 30-65 mass %, $Al_2O_3$: 25-50 mass %, CaO: 10-30 mass %;

(C) $SiO_2$: 10-30 mass %, $Al_2O_3$: 25-50 mass %, CaO: 30-55 mass %;

the width of an inclusion is a diameter of the inclusion measured in a direction perpendicular to a long axis of the inclusion, when the inclusion is observed in a cross section including a longitudinal axis of the wire; and concentrations in formulae (A) to (C) are normalized so that a total concentration of the three components $SiO_2$, $Al_2O_3$, and CaO amounts to 100 mass %.

2. The ultra clean spring steel as of claim 1, wherein the wire is formed from a steel comprising;

C: no more than 1.2 mass % (excluding 0%);

Si: 0.4 to 4 mass %;

Mn: 0.12.0 mass; and

Al: no more than 0.01 mass % (excluding 0%).

3. The ultra clean spring steel of claim 1, wherein the wire is formed from a steel comprising at least one member selected from the group consisting of Cr, Ni, V, Nb, Mo, W, Cu, and Ti.

4. The ultra clean spring steel as defined in claim 1, wherein the wire is formed from a steel comprising Li in an amount of 0.01 to 20 ppm.

* * * * *

UNITED STATES PATENT AND TRADEMARK OFFICE

CERTIFICATE OF CORRECTION

PATENT NO. : 7,429,301 B2
APPLICATION NO. : 11/284807
DATED : September 30, 2008
INVENTOR(S) : Sugimura et al.

It is certified that error appears in the above-identified patent and that said Letters Patent is hereby corrected as shown below:

On the title page, Item (73), the Assignee information is incorrect. Item (73) should read:

--(73) Assignee: Kabushiki Kaisha Kobe Seiko Sho (Kobe Steel, Ltd.)
Kobe-shi, (JP)--

Signed and Sealed this

Second Day of December, 2008

JON W. DUDAS
*Director of the United States Patent and Trademark Office*